United States Patent [19]

Tippmann

[11] 4,299,060

[45] Nov. 10, 1981

[54] INSULATED DOOR AND WINDOW CONSTRUCTION

[76] Inventor: Eugene R. Tippmann, 10120 Isle Pine Dr., Fort Wayne, Ind. 46815

[21] Appl. No.: 69,317

[22] Filed: Aug. 24, 1979

[51] Int. Cl.[3] ..... E06B 3/00

[52] U.S. Cl. ..... 49/501; 49/504; 49/505; 52/212

[58] Field of Search ..... 49/501, 504, 505; 52/212

[56] References Cited

U.S. PATENT DOCUMENTS

| | | | |
|---|---|---|---|
| 2,249,257 | 7/1941 | Rumney et al. | 52/212 |
| 3,184,016 | 5/1965 | Smith et al. | 52/212 |
| 3,375,627 | 4/1968 | Bursiek et al. | 49/504 X |
| 3,418,755 | 12/1968 | Di Chiaro | 49/501 |
| 3,975,881 | 8/1976 | Minowski, Jr. | 49/501 X |
| 4,057,936 | 11/1977 | Wyatt, Jr. | 49/61 |

FOREIGN PATENT DOCUMENTS

| | | | |
|---|---|---|---|
| 1353464 | 5/1974 | United Kingdom | 49/504 |

*Primary Examiner*—Kenneth Downey

*Attorney, Agent, or Firm*—Joseph J. Baker; Gerald J. Ferguson, Jr.

[57] ABSTRACT

Within an opening in a wall is placed a window or door having a frame, consisting of metal and plastic interlocked extrusions with a polyurethane core therein. The polyurethane core prevents penetration of condensate therethrough to the underlying casement consisting of wood studs, sheeting and dry wall.

Within the frame is a sash comprised of a set of metal and plastic extrusions which are interlocked and also form a cavity with a solid polyurethane core. The two extrusions have glazing beads to receive a glazing consisting of a double pane of glass separated to provide an insulating dead air space.

5 Claims, 5 Drawing Figures

INSULATED DOOR AND WINDOW CONSTRUCTION

BACKGROUND OF THE INVENTION

The wear life of a window sash is unnecessarily limited because of water damage. How this arises, is that during the winter months in the northern climate, when warm interior air comes into contact with a cold window, there is water condensation, and the condensed water forms on the existing barriers whether they be plastic or metal cladding, and gains access to the underlying wooden frame surrounding the window opening, there causing damage to the wood. In a brief time, the frame rots and the window or door either falls out of place or the frame must be replaced.

The state of the present art is such that these window constructions are inferior because they serve as inadequate thermal barriers, and are thus sources of heat loss from a heated or cold interior to ambient exterior temperature.

There have been numerous proposals to correct these deficiencies, including cladding the frame both from the inside and the outside with a metal or plastic sheeting. Other proposals are to give protective coatings, including varnishes, chemical penetrants and other such coatings. While helping to some degree, the wood frame, after exposure over a period of time, is penetrated by moisture, and rots or warps, and must then be replaced.

The described construction lacks sufficient insulation and thus the window becomes a serious source of heat loss in modern dwellings and office buildings.

SUMMARY OF THE INVENTION

What the present invention seeks, is not only to secure an improved insulation for windows and doorways, but also to protect the surrounding wood construction forming part of the wall in which an opening is cut to provide a door or window, with the result that the door or window will last longer and be better insulated during its useful life.

Another object of the present invention is to provide an insulation in the form of a core of polyurethane which is encased within the cavity of two extrusions, one aluminum and the other polyvinyl chloride, which are interlocked to form a cavity for the polyurethane core. The aluminum extrusion, being disposed at the outside and the polyvinyl chloride extrusion being disposed at the inside, have different coefficients of expansions, which, when exposed to different temperatures, produce linear expansions which are matched so that at the different temperatures to which they are exposed, will expand and contract somewhat evenly, and thus maintain the dimensional stability of the frame and sash regardless of the temperature differential of outside and inside temperatures respectively.

Another object of the present invention is to provide not only an insulation which has dimensional stability, but also one which has a high degree of thermal barrier efficiency and which forms an intermediate surface between the wall construction in which the opening is cut, and the casement (in the case of a window) or jamb (in the case of a door).

Another important object of the present invention is to provide in the aforesaid frame, a recess in which there is slideably received a sash also consisting of interlocked extrusions of plastic and metal which are interlocked to form a continuous cavity to receive a substantially solid core of polyurethane. Thus, surrounding the core of polyurethane in the sash are external extrusions of polyvinyl chloride on the one side and aluminum on the other, the two extrusions being interlocked to form a continuous protective lamination over the polyurethane core.

A still further object of the present invention is to provide glazing beads by the metal and plastic extrusions respectively which grip and firmly hold the glasing consisting of two separated panes of glass with a dead air space therebetween.

An overall object of the present invention is to provide a well insulated window or door construction in which the surrounding opening consisting of wood is well protected against collection of water which is inevitably present when a differential temperature exists on two sides of a wall, and the warmer temperature side includes moisture which will condense and tend to penetrate around the window and/or door construction to the underlying wall members constructed of wood.

An important feature of the present invention is the process by which the sash is formed from two interlocked extrusions which are at least partially opened to receive an expandable charge of polyurethane, the two extrusions then being closed, reinforced exteriorly, and then the polyurethane expanded to fill the cavity and be polymerized to a stable interior core filling the cavity.

Another important feature of the invention is to form the core and extrusions as just described and then to cut the assembly in half to form jamb sections with the polymerized polyurethane forming one external side of the jamb.

Other objects and features of the present invention will become apparent from a consideration of the following description which proceeds with reference to the accompanying drawings wherein certain selected example embodiments of the invention are illustrated by way of example and not by way of limitation.

DRAWINGS

DETAILED DESCRIPTION OF THE INVENTION

Figure 1:
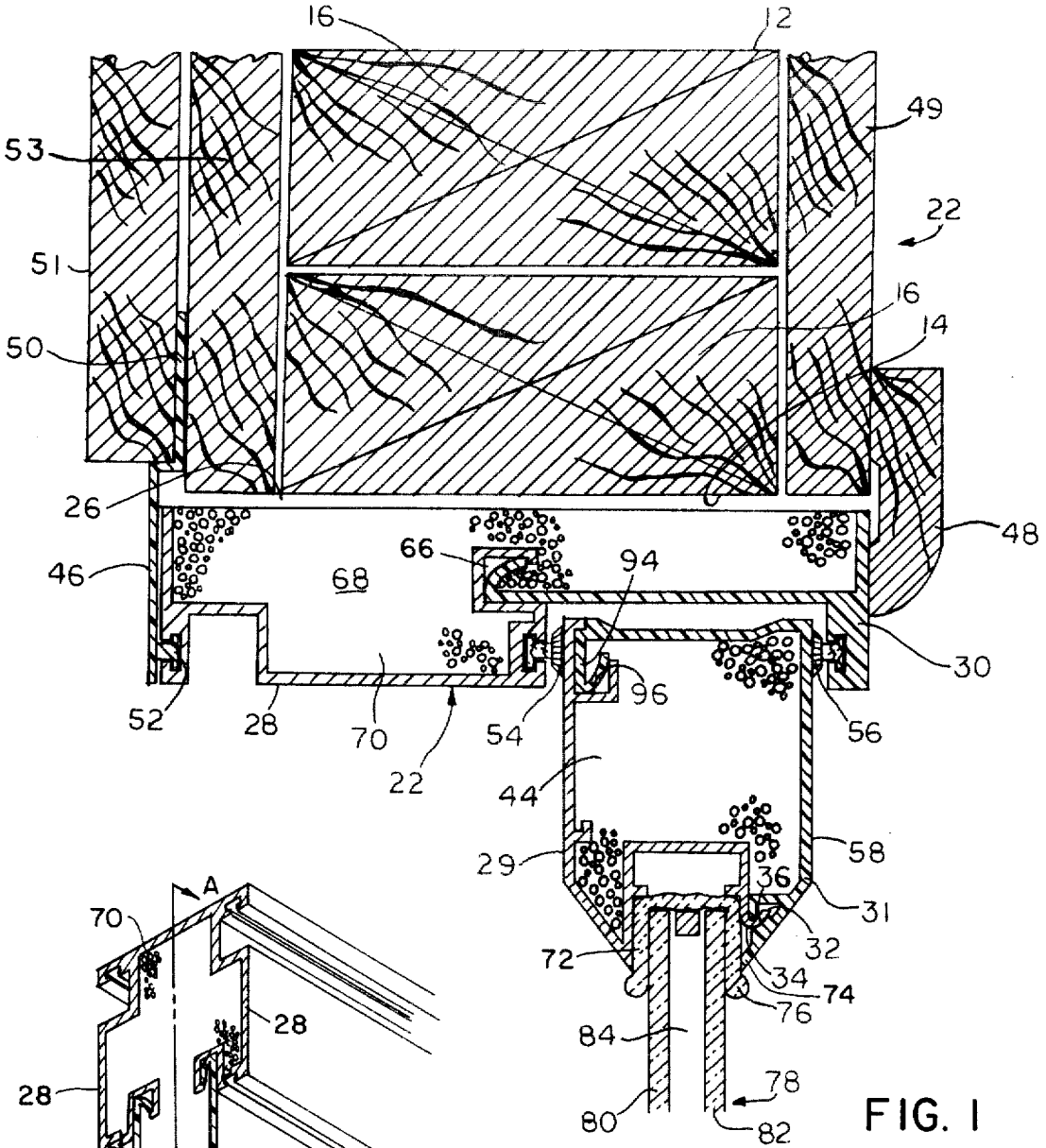
FIG. 1 is an enlarged detail cross section which illustrates the invention as it applies to a window construction.

Referring now to the drawings, a window designated generally by reference numeral 10, is mounted in a wall 12 in which there is first cut a window opening 14. Surrounding the opening 14 are wood studs 16, sill 18, and an overhead wood span 20. Fitted within opening 14 is a frame 22 which fits within casement 26 and fills the opening 14.

Frame 22 (FIG. 1) consists of an aluminum extrusion member 28 and a polyvinyl chloride extrusion member 30 which are slideably interlocked at 32 by means of an elongated rib 34 formed integrally with the polyvinyl chloride extrusion member 30 and which fits within a channel 36 formed integrally with the aluminum extrusion member 28. The two interlocked extrusions 28,30 at 66 form a longitudinal cavity 68 in which is received a continuous substantially void-free core 70 of polyurethane which provides a thermal and moisture barrier overlying the subjacent wood structure consisting of studs 16, sill 18 and span 20 of the wall 12.

Overlying the casement 26 are flashing 46 on the outside and internal trim 48. The external flashing 46 has a fin 50, held between siding 51 and sheeting 53. The flashing is mechanically secured by keyed connection 52 to the aluminum extrusion 28. In another embodiment shown in FIG. 3, the flashing 110 is formed integral with the aluminum extrusions 28 and is held between the siding 51 and the sheeting 53.

In the case of a sliding window, (FIG. 1) there is mounted within each of the extrusions felt brushes 54,56 which permit sash 58 to move relative to the fixed casement 26 and frame 22.

Figure 1A:
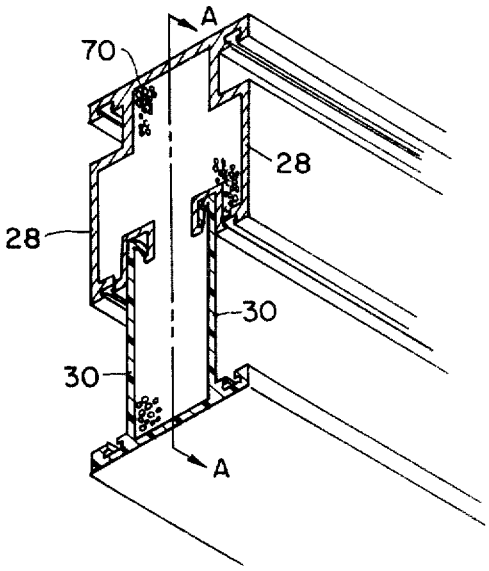
FIG. 1A is a partial perspective view of the plastic and metallic extrusion members prior to being cut longitudinally along the line A—A.
Figure 3:
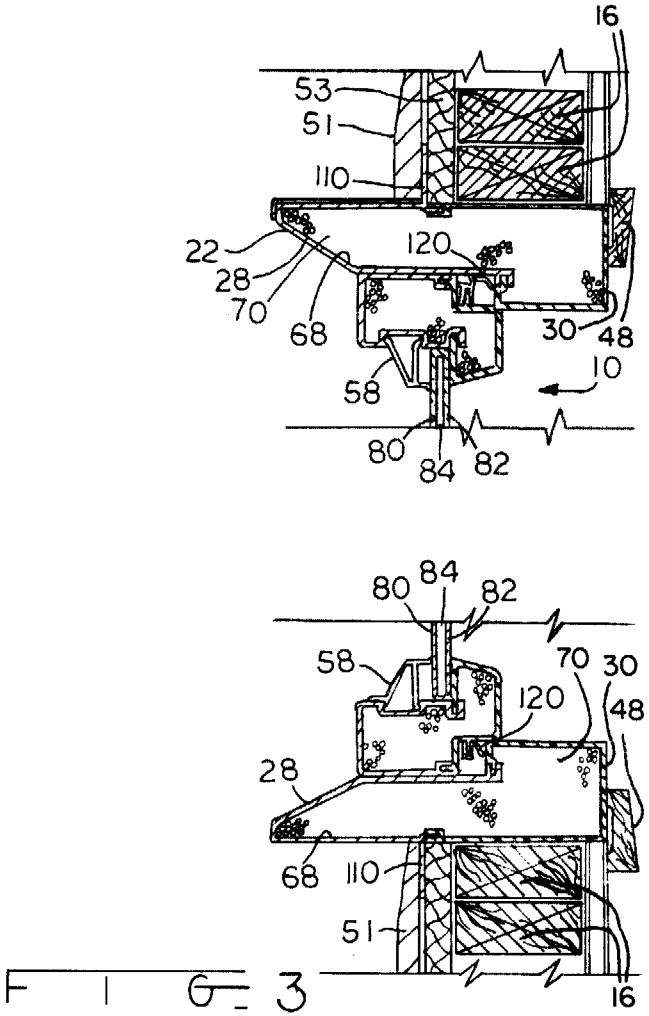
FIG. 3 is a sectional view taken of the wall construction with the window glazing partially removed and the sash sides drawn together.
Figure 2:
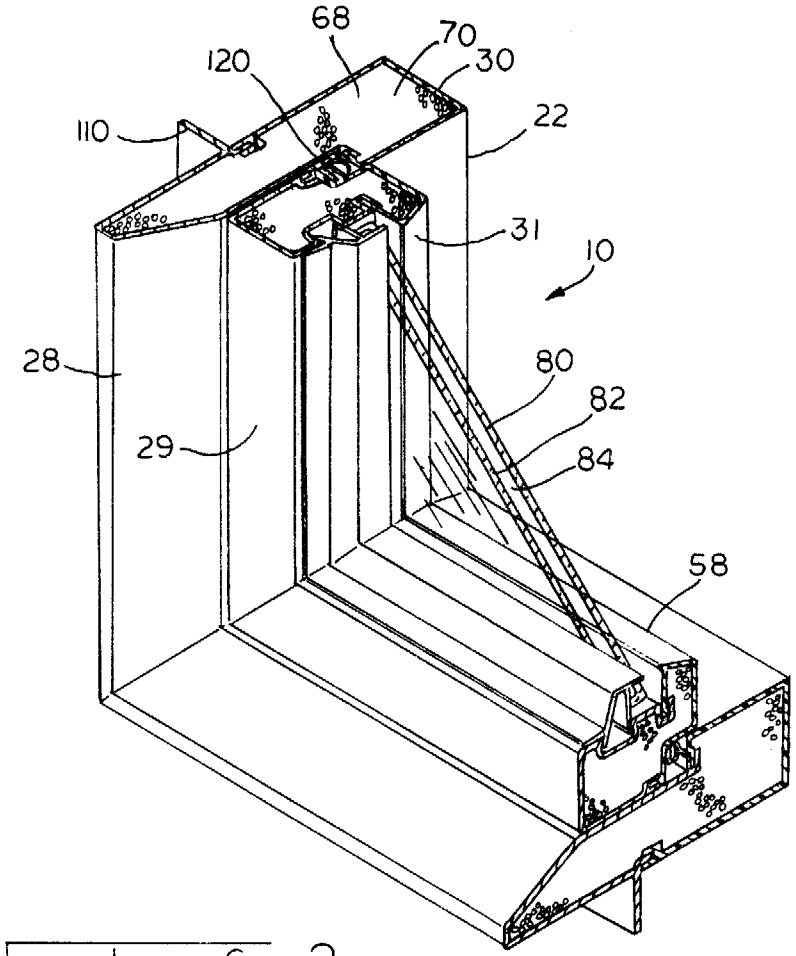
FIG. 2 is an isometric enlarged detail view of a corner of a window frame construction, made in accordance with the invention, and including the sash, glazing and glazing bead construction.

When the two frame extrusion members 28,30 are joined together, they form a continuous cavity 68 in which there is disposed a substantially uniform cross-section core 70 of polyurethane plastic material formed interiorly of an enclosed set of the extrusions 28,30 which are coupled together and remain coupled as shown in FIGS. 2, 3. The extrusions 28,30 can be double formed as shown in FIG. 1A, are coupled, and then cut longitudinally in half to expose one half of the core 70 shown in FIG. 1. The foaming is also as described for the sash extrusions 29,31, FIGS. 2,3,4.

At the ends of each sash extrusion is a glazing bead 72,74 which overlies a U-shaped cross-section seal 76 clamping a glazing 78 consisting of two separated panes 80,82 of glass having a separation forming a dead air space 84 between the two panes 80,82.

The sash 58 is movable relative to the frame, allowing air ventilation from the exterior to the interior, but when closed prevents such air passage because of the felt brush seals 54,56.

PROCESS FOR PRODUCING ARTICLE

Figure 4C:
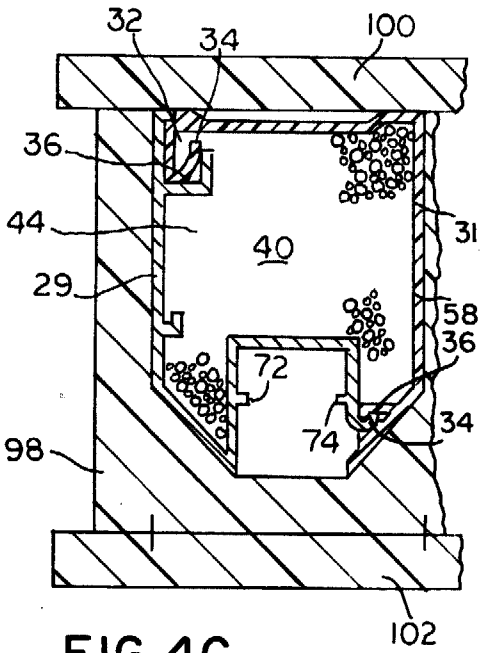
FIGS. 4A, 4B, 4C illustrate the progressive steps for making the sash by expanding the plastic core within the extrusions which form the cavity for a gliding or slideable door and window construction.
Figure 4B:
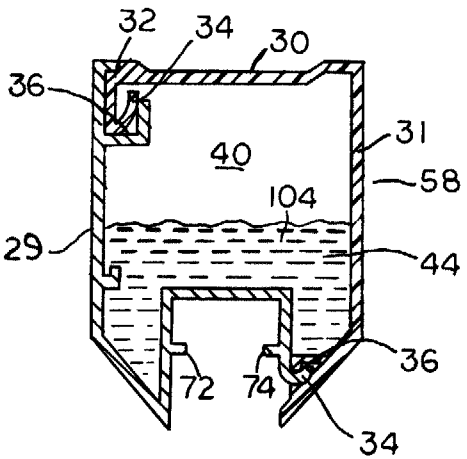
Figure 4A:
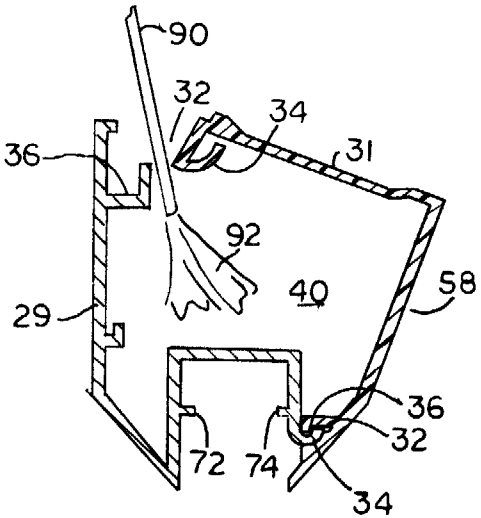

In the process for producing the sash section as illustrated in FIGS. 4A, 4B, 4C, extrusions 29,31 are first coupled together through a slide connection 32, rib 34, and channel 36. The slide connection serves as a hinge (FIG. 4A) with the two extrusions 29,31 separated to permit a charge nozzle 90 to inject polyurethane flow 92 into longitudinal cavity 40 (FIG. 4A) following which resilient rib 34 of extrusion 31 is snap-fitted into channel 36 of extrusion 29. The two extrusions 29,31 are then backed by a die 98, cover 100, and base 102 FIG. 4C to prevent the sides of the now securely coupled extrusions 29,31 from buckling during expansion of the polyurethane 44 in the cavity 40 formed by the enclosure from the two extrusions 29,31. The unpolymerized polyurethane charge indicated schematically by reference numeral 104 expands so that it fills the interior cavity or chamber 40 forming a core 44 of polyurethane. The foamed polyurethane core 44 is an efficient thermal barrier and is also water resistant.

The heating can occur within heating chamber, and by a continuous process which is fully described in my issued U.S. Pat. No. 4,149,840, titled, "APPARATUS FOR PROCUDING RIGID FOAM PLASTIC INSULATING PANELS," issued Apr. 17, 1979.

The frame section is also made up of two extrusions, a plastic extrusion and an aluminum extrusion, constructed in the same way as the sash, section that is, the two extrusions are coupled together partially, there is an opening providing inflow of charge of polyurethane, the two sections are snapped together, to form a complete enclosure, and then passed through a heating apparatus of the type previously described, and the polyurethane is expanded, polymerized, and fills, to form a core within the cavity defined by the two extrusions. The two extrusions can then be cut in half along a cutting plane dividing the two halves and extending along the length, as shown in FIG. 1A so that the polyurethane is exposed to form a side of the casement, as is shown in FIG. 1, or the two sides can remain together, to form the casement illustrated in FIGS. 2, 3. In the event the frame in constructed in accordance with that illustrated in FIGS. 2, 3, the aluminum extrusion includes an integral flashing 110 which is received between the siding and the sheeting, instead of providing a separate flashing in the manner illustrated in FIG. 1 and which is mechanically secured to the aluminum extrusion.

In the embodiment shown in FIGS. 2, 3, the frame and sash are secured together mechanically by means of a wishbone cross-section expander clip 120.

An important feature of the present invention, as shown in FIGS. 1, 2, 3 is that water is prevented from condensing, and gaining ready access to the studs and internal wood casement.

In the previous window constructions and door constructions, there was inevitably a condensation from warm air striking the colder surface of the cooler air on opposite sides of the window and door, and the condensed water then tended to collect between the wood casement and the window frame and, while collecting at that location, caused rotting of the wood frame adjacent the frame. In the present invention, this condensation of water is either precluded or greatly reduced because the polyurethane forms a protective heat insulation and barrier against such ingress of condensed water. As a result, the wood casement surrounding the frame is protected against such rotting and deterioration by serving as an effective barrier excluding the currents of condensed water.

Another important feature of the present invention is that the two extrusions which form the interior and exterior sections of the frame and sash, are each of different thermal expansion. Thus, the two, being responsive to differential temperatures, are more evenly matched in the total linear expansion at the inner side and outer side of the window. This contributes to a greater dimensional stability, and effectively prevents distortion of the window and door construction when exposed to severe temperature differentials on opposite sides of the window and door, this being a common occurrence especially when the windows and doors are subjected to strong, direct sunlight, or substantial temperature differentials which normally occur in northern climates, while the interior of the home is heated to an inside temperature and the external, or ambient, temperature is greatly different.

OPERATION

Figure 5:
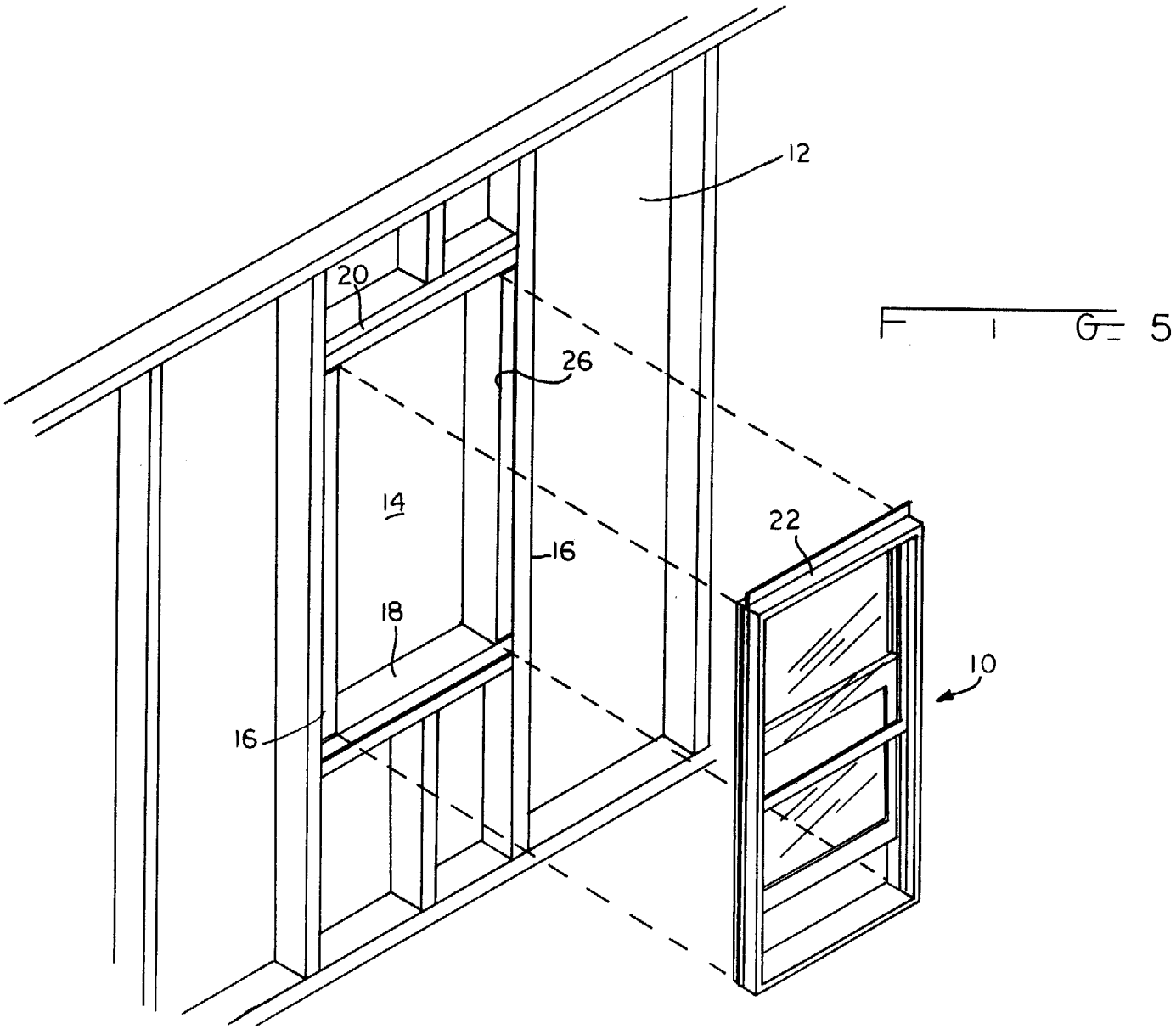
FIG. 5 is a schematic exploded isometric detail view of the double hung window and wall construction incorporating the present invention.

In practice, to mount or fit the windows in the present invention, there is first cut an opening of the desired size and location in the sheeting and studs of the wall (FIG. 5) and the frame 22 is inserted in place and attached to the casement made up of the studs and sheeting. Flashing is then applied at the exterior and trim at the interior.

The frame 22 comes preassembled either with or without the sash 58.

Once mechanically installed, the polyurethane core 44 of the sash and the polyurethane core 70 in the frame serve as a barrier against water reaching the underlying wood studs 16 and sheeting 53 and drywall 49.

The polyurethane is virtually impenetrable to the migration of moisture therethrough, so it serves as a continuous protection against water condensate reaching the underlying wood and thereby causing ultimate rotting, deterioration, warpage and the like, of the wood material.

The sash 58, including the attached glazing 80,84, is mounted within the frame 22 and the sash 58 can move relative to the frame 22 to open and close the window. A screen (not shown) may also be provided to cover the window opening when the window is open.

The described construction is economical to produce, since the aluminum and polyvinyl extrusions described are readily obtainable. Previously, any proposed extrusion combination forming a cavity with a core of polyurethane was impractical, since it was not thought feasible to provide extrusions of different material and irregular cross-section forming a cavity wherein there could be formed a core of polyurethane. This is no longer the case, since polyurethane is the described core material by a continuous process which is fully described in my now issued U.S. Pat. No. 4,149,840, entitled, "APPARATUS FOR PRODUCING RIGID FOAM PLASTIC INSULATING PANELS," issued Apr. 17, 1979. This apparatus and process described in my issued patent make it possible to produce, continuously, on an endlessly movable belt, spaced molded polyurethane products which are injected in situ, polymerized, shaped to the desired cross-section and dimension, and then released at the end of the conveyer, the conveyer then returning to the original startup point where it receives additional quantities of polyurethane in turn foamed, sized, polymerized and fully heat-treated, and expelled in the aforementioned manner.

Cores of the polyurethane are readily manufacturable both to the cross-section dictated by the frame 22 and by the sash 58.

The present invention is a combination of the described method for continuously forming polyurethane cores, together with the described extrusions, which make the present invention possible. Because of the direct proximity of the polyurethane to the underlying wood sheeting and studs, it is possible to effectively exclude water, which inevitably develops as a result of the condensation of moisture contained in warm, wet air coming into contact with air at a cooler and dryer condition separated by the described window construction. Such condensed water has proved heretofore substantially deteriorative of the wood construction and wood material, and which it is the present purpose of this invention to correct.

The structural integrity of the window is one of its substantial advantages. For example, the aluminum and plastic extrusions have differential rates of expansion and contraction but, being exposed to ambient temperature conditions at the interior and exterior of an enclosure, as, for example, a house, office building or the like, causes them to expand and contract at substantially the same linear gross amount because their differential rates of expansion are matched to the differential temperatures, thus assuring greater structural stability.

While a particular embodiment of the present invention has been shown and described, it will be obvious to those skilled in the art that changes and modifications may be made without departing from the invention in its broader aspects. Accordingly, the aim in the appended claims is to cover all such changes and modifications as follow in the true spirit and scope of the invention.

What is claimed is:

1. In a door or window construction for an opening in a building wall having an exterior and interior surface, said construction comprising:

(a) an insulated frame conforming with the outline of the surface of said opening, said frame having a metallic member extending from said exterior surface of said wall to a point intermediate said wall opening and terminating in a connection element along the longitudinally extending edge thereof, a plastic member extending from said interior surface of said wall to said metallic member, said plastic member terminating in a connection element along the longitudinally extending edge thereof which is in direct interlocking relationship with said connection element on said metallic member, said metallic and plastic members forming a cavity when so interlocked, and a polyurethane foamed core disposed within said cavity to form a moisture and thermal barrier between said metallic and said plastic members and said surface of said wall opening, and (b) a movable inner sash operatively associated with said frame comprising peripheral members each including an outer metallic member having connecting elements on the opposing longitudinally extending edges thereof, an inner plastic member having connecting elements on the opposing longitudinally extending edges thereof which when mated with said connecting elements on said metallic member form a continuous thermal interlock between said plastic and metallic members, said metallic and plastic members forming hollow members when so interlocked, and a polyurethane foamed core disposed within said hollow members to form a moisture and thermal barrier between said metallic and said plastic members.

2. The construction as set forth in claim 1 further comprising:

(a) a glass pane, said sash having a substantially continuous gripping connection with the perimeter of said glass pane, and (b) a recess in said frame having brush means for providing a seal between said frame and said sash.

3. The construction as set forth in claim 2 wherein said plastic member consists of polyvinyl chloride and said metallic member consists of aluminum.

4. A process for making an insulated door or sash frame element comprising the steps of:

(a) providing a metallic frame member having first and second connection elements on the longitudinally extending edges thereof, (b) providing a plastic frame member having first and second connection elements on the longitudinally extending edges thereof, (c) joining said first connection elements of said metallic and said plastic frame members together so as to form a cavity between said metallic and said plastic frame members, (d) partially separating said second connection elements of said metallic and said plastic members, (e) partially filling said cavity through said partial separation with polyurethane materials, (f) joining said second connection elements of said metallic and said plastic frame members, (g) backing said plastic and metallic frame members to prevent distortion thereof, and (h) heating said polyurethane materials to expand it to fill said entire cavity.

5. The process as set forth in claim 4 comprising the further step of securing a thermally insulated glass pane to said frame element.

* * * * *